US010342115B2

(12) United States Patent
Song et al.

(10) Patent No.: US 10,342,115 B2
(45) Date of Patent: Jul. 2, 2019

(54) HIGH-FREQUENCY-TUNING SLIDING ELECTRICAL CONTACT

(71) Applicant: HEFEI CAS ION MEDICAL AND TECHNICAL DEVICES CO., LTD, Hefei, Anhui (CN)

(72) Inventors: Yuntao Song, Anhui (CN); Manman Xu, Anhui (CN); Gen Chen, Anhui (CN); Yongsheng Wang, Anhui (CN); Guang Liu, Anhui (CN)

(73) Assignee: HEFEI CAS ION MEDICAL AND TECHNICAL DEVICES CO., LTD., Hefei (CN)

( * ) Notice: Subject to any disclaimer, the term of this patent is extended or adjusted under 35 U.S.C. 154(b) by 0 days.

(21) Appl. No.: 16/116,867

(22) Filed: Aug. 29, 2018

(65) Prior Publication Data

US 2019/0059150 A1 Feb. 21, 2019

Related U.S. Application Data

(63) Continuation of application No. PCT/CN2017/115352, filed on Dec. 9, 2017.

(30) Foreign Application Priority Data

Jan. 19, 2017 (CN) ..... 2017 1 0044032

(51) Int. Cl.
*H05H 13/00* (2006.01)
*H01R 41/00* (2006.01)
*H05H 7/04* (2006.01)

(52) U.S. Cl.
CPC ..... *H05H 13/005* (2013.01); *H01R 41/00* (2013.01); *H05H 7/04* (2013.01); *H01R 2201/12* (2013.01)

(58) Field of Classification Search
CPC ..... H05H 13/00; H05H 13/005; H05H 13/02; H05H 7/04; H05H 13/04; H01R 41/00; H01R 2201/12
See application file for complete search history.

(56) References Cited

U.S. PATENT DOCUMENTS

| | | | | |
|---|---|---|---|---|
| 9,084,599 | B2 * | 7/2015 | Zeiner | A61B 17/068 |
| 9,106,035 | B2 * | 8/2015 | Erdos | H01R 13/10 |
| 2011/0237124 | A1 * | 9/2011 | Flaherty | H01R 13/6277 439/578 |

FOREIGN PATENT DOCUMENTS

| | | | |
|---|---|---|---|
| CN | 1212083 | A | 3/1999 |
| CN | 2319929 | Y | 5/1999 |
| CN | 202855679 | U | 4/2013 |

(Continued)

*Primary Examiner* — Thai Pham
(74) *Attorney, Agent, or Firm* — Wayne & Ken, LLC; Tony Hom

(57) ABSTRACT

Disclosed is a high-frequency-tuning sliding electrical contact. The contact includes a tuning ring which is composed of an inner elastic piece, an upper base, an outer elastic piece and a lower base. Pull rods are welded to an upper side face of the upper base, and upper ends of the pull rods are driven to move up and down by a motor, so that the tuning ring slides up and down between the outer sleeve and the inner sleeve along the pull rods. The overall structure of the novel electrical contact is simple, compact and economical. The disclosure reduces joule heat produced by contact resistance and prevents contact surface fusion welding or conductive damage, and is especially suitable for tuning in a small gap range.

8 Claims, 3 Drawing Sheets

(56) References Cited

FOREIGN PATENT DOCUMENTS

| | | | |
|---|---|---|---|
| CN | 205508699 | U | 8/2016 |
| CN | 106558825 | A | 4/2017 |
| CN | 206379602 | U | 8/2017 |
| WO | 2011123225 | A1 | 10/2011 |

* cited by examiner

HIGH-FREQUENCY-TUNING SLIDING ELECTRICAL CONTACT

CROSS-REFERENCE TO RELATED APPLICATIONS

This application is a continuation of International Application No. PCT/CN2017/115352 with a filing date of Dec. 9, 2017, designating the United States, now pending, and further claims to Chinese application No. 201710044032.5 with a filing date of Jan. 19, 2017. The content of the aforementioned applications, including any intervening amendments thereto, are incorporated herein by reference.

TECHNICAL FIELD

The disclosure belongs to the electrical contact technology of a tuning ring of a cyclotron high-frequency system, and relates to a high-frequency-tuning sliding electrical contact, which is especially suitable for sliding tuning in a small gap range.

BACKGROUND

Cyclotrons are widely applied in the field of nuclear medicine, especially in the fields of radiopharmaceuticals, tumor treatment, etc. A host system of a superconducting cyclotron accelerates ions by using an electromagnetic field of a resonant cavity, and a tuning ring is an important part to realize the tuning of the resonant cavity. The tuning ring should be able to make slight adjustment of a RF cavity frequency in real time, whether under a stop condition or an operation condition of the cyclotron. Therefore, it is necessary that the electrical contact between an electrical contact member and an inner and an outer sleeve wall is performing well and that the electrical contact member can slide up and down freely, which puts forward very high requirements for the electrical contact, thermal coupling, pressure resistance and service life, etc. of the contact. However, the traditional electrical contacts are prone to wear wall surfaces. Moreover, in the tuning ring adjustment process, there is a relatively large line current density, which may generate an instantaneous current, easily causing sparking phenomenon and electromagnetic interference to the RF cavity. In order to solve the above problems, a solution is now provided.

SUMMARY

The disclosure aims to provide a high-frequency-tuning sliding electrical contact which solves the electrical contact problem of an inner and an outer sleeve wall of a tuning ring of a cyclotron during tuning by adopting a sliding electrical contact. The electrical contact has a simple and compact structure with small external dimensions, high sensitivity and the like. It further has the advantages that an electrical contact member meets the bidirectional requirements of ensuring axial sliding and good electrical contact, has little influence on the magnetic field of the RF cavity, and the like.

The objective of the disclosure can be realized by the following technical solution:

A high-frequency-tuning sliding electrical contact includes a tuning ring sliding between an outer sleeve and an inner sleeve. The outer sleeve is sleeved on the inner sleeve. The tuning ring is composed of an inner elastic piece, an upper base, an outer elastic piece and a lower base. The upper base and the lower base are welded as a whole. The inner elastic piece and the outer elastic piece are uniformly provided along an axial direction and are welded on the lower base. Pull rods are welded to an upper side face of the upper base, and upper ends of the pull rods are driven to move up and down by a motor so that the tuning ring slides up and down between the outer sleeve and the inner sleeve along the pull rods.

An upper group and a lower group of pull rods, with a total of eight independent pull rods are provided. The upper group and the lower group of pull rods are staggered 90 degrees and are evenly provided along the axial direction. The upper and lower groups of pull rods are connected through a guide disk.

The inner elastic piece and the outer elastic piece have a width of 5 mm. A contact spring is provided between the inner elastic piece and the lower base and between the outer elastic piece and the lower base, respectively.

The inner elastic piece and the outer elastic piece are both made of a Be—Cu contact material with silver plating on the surface, and have a thickness of at least 50 um.

Front ends of the inner elastic piece and the outer elastic piece are bent and then clamped in grooves on an upper part of the lower base. The surfaces of the inner and outer elastic pieces adopt silver graphite ball head self-lubrication.

The upper base is made of a copper material. The lower base is made of insulated alumina ceramic.

An annular water channel is provided in the lower base along an annular direction thereof. A water mutually communicated inlet channel and water outlet channel are provided at two opposite sides of the annular water channel, respectively, to form a circulating water channel. The water inlet channel and the water outlet channel are both provided penetrating through the upper base.

Operating requirements and parameters of the tuning ring are as follows: the tuning ring has an operating frequency of 90 MHz and a fed RF power of 120 kW. A moving speed of the electrical contact member is controlled between 0.01 mm/s and 0.1 mm/s. The inner sleeve has a surface magnetic field strength of 100 A/m. A RF frequency modulation cavity has a surface magnetic field strength of about 10 A/m. The temperature of the inner sleeve, the electrical contact member and the RF frequency modulation cavity is controlled below 80 degrees Celsius.

BENEFICIAL EFFECTS OF THE DISCLOSURE

A novel electrical contact is adopted to solve the problems of too small gap, great operation difficulty and the like in the tuning ring adjustment process of the cyclotron high-frequency system. The elastic pieces are made of a Be—Cu alloy with silver plating on the surfaces, increasing abrasion resistance, and thus the problem of excessive contact resistance caused by temperature rise on the surfaces of the elastic piece materials can be effectively avoided. The disclosure has a simple and compact overall structure, is economical and applicable, effectively reducing joule heat generated by contact resistance, avoiding contact surface fusion welding or conductive damage, and is especially suitable for tuning in a small gap range.

BRIEF DESCRIPTION OF THE DRAWINGS

In order to facilitate the understanding of those skilled in the art, the present disclosure will be further explained below with reference to the accompanying drawings.

REFERENCE NUMERALS

1. pull rod; 2. guide disk; 3. outer sleeve; 4. tuning ring; 5. inner sleeve; 6. inner elastic piece; 7. upper base; 8. outer elastic piece; 9. lower base; 10. water inlet channel; 11. water outlet channel; 12. annular channel; 13. contact spring.

DETAILED DESCRIPTION OF THE PRESENT INVENTION

Hereinafter, the technical solution of the present disclosure will be described clearly and completely with reference to the embodiments. Obviously, the described embodiments are only a part other than all of the embodiments of the present disclosure. Based on the embodiments of the present disclosure, all other embodiments obtained by those skilled in the art without creative labor are within the protection scope of the present disclosure.

Figure 1:
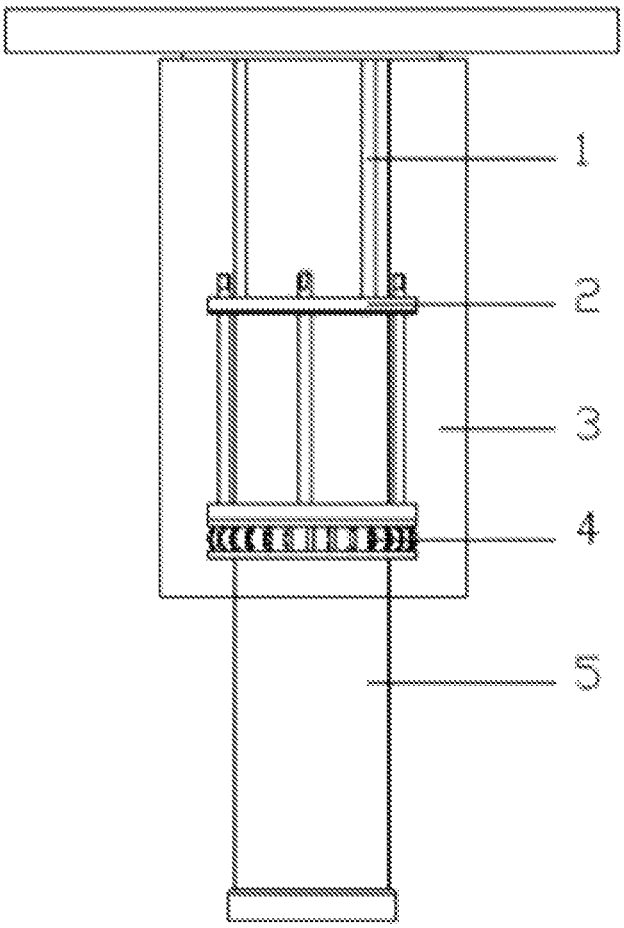
FIG. 1 is an overall schematic diagram of a high-frequency-tuning sliding electrical contact.
Figure 2:
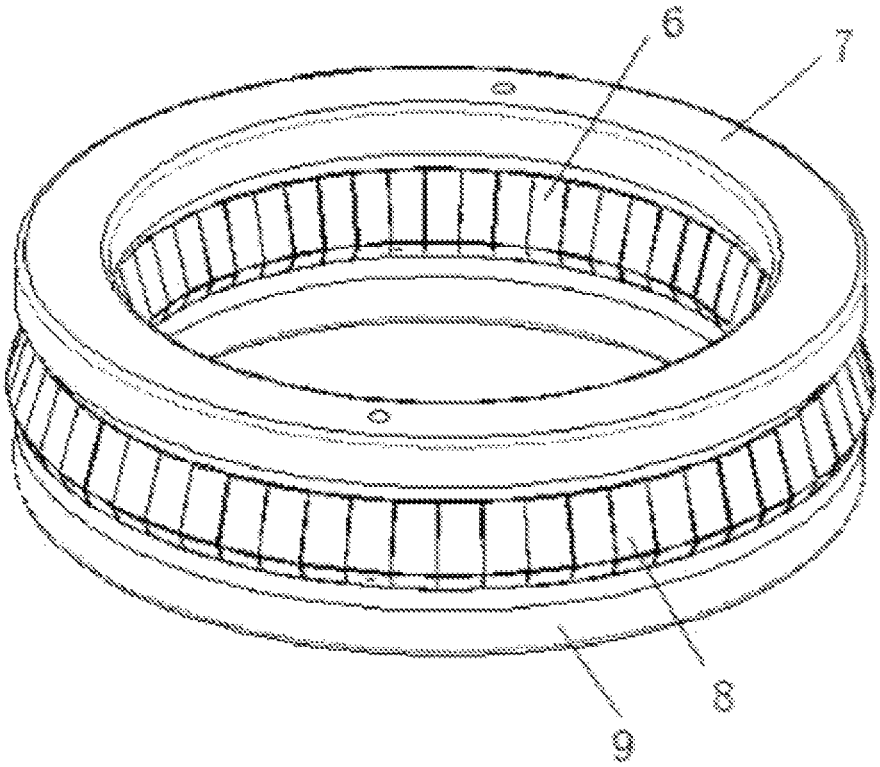
FIG. 2 is a schematic diagram of a tuning ring shown in FIG. 1 of the present disclosure.
Figure 3:
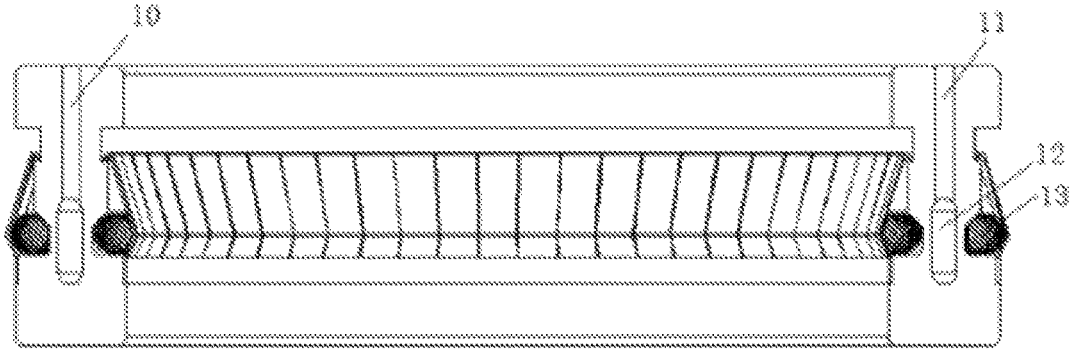
FIG. 3 is a cross-sectional view of an electrical contact.

A high-frequency-tuning sliding electrical contact which is designed to be matched with an overall system of a tuning ring, referring to FIGS. 1, 2 and 3, includes a tuning ring 4 sliding between an outer sleeve 3 and an inner sleeve 5. The outer sleeve 3 is sleeved on the inner sleeve 5. The tuning ring 4 is composed of an inner elastic piece 6, an upper base 7, an outer elastic piece 8 and a lower base 9. The upper base 7 and the lower base 9 are welded as a whole. The inner elastic piece 6 and the outer elastic piece 8 are uniformly provided along an axial direction and are welded on the lower base 9. The inner and outer elastic pieces have a width of 5 mm. The inner elastic piece 6 and the outer elastic piece 8 have different bending curvatures. A contact pressure is set through a contact spring 13 to ensure that an elastic force between sleeve walls and the elastic pieces is appropriate, so as to avoid poor contact, and to avoid damage to the elastic pieces caused by excessive friction, which affects the contact effect.

Pull rods 1 are welded to an upper side face of the upper base 7. An upper group and a lower group of pull rods 1 with a total number of eight are provided, which are mainly configured to guide the upper and lower sliding of the electrical contact. In order to solve the deflection problem caused by the pull rods 1, the upper group and the lower group of pull rods are staggered 90 degrees and are evenly provided along the axial direction. The upper and lower groups of pull rods are connected through a guide disk 2 which plays a role in stabilizing the pull rods. Upper ends of the pull rods 1 are connected with a motor which drives the pull rods to move up and down, so that the tuning ring 4 slides up and down along the pull rods 1 to realize frequency tuning.

Friction motion takes place between the elastic pieces and the sleeve walls during adjustment of the tuning ring 4. In order to avoid surface contact during sliding of the elastic pieces, which causes excessive local temperature rise and melting of surface materials and increases contact resistance and electrical wear, thus causing adverse consequences such as sparking, fusing, excessive local joule heat and directly affecting the contact effect, the elastic pieces adopt a new type of Be—Cu contact material with silver plating on the surfaces, which can ensure the conductivity of the tuning ring during the adjustment. Considering RF loss, the elastic pieces have a thickness of at least 50 um. The Be—Cu alloy has the characteristics of wear resistance, low temperature resistance, non-magnetism, etc., and has the advantages of good conductivity, thermal conductivity, low and stable contact resistance, fast arc moving speed, no spark impact, good wear resistance, high strength, good ductility, excellent processability, simple production process, low cost, etc. Therefore, the Be—Cu alloy can ensure that the elastic pieces have good thermal coupling and high pressure resistance, thus are suitable for sliding contact and are widely used in the manufacturing field.

Front ends of the inner elastic piece 6 and the outer elastic piece 8 are bent and then clamped in grooves on an upper part of the lower base 9, so as to prevent the elastic pieces from falling off during upper and lower sliding, and ensure that convex parts of contacts of the elastic pieces can be in good contact with the inner and outer sleeve walls. In order to prolong the service life, the contacts are heat treated. Meanwhile, in order to avoid abrasion when the contacts slide up and down, a silver graphite ball head self-lubrication method is adopted. The upper base 7 is made of a copper material with good conductivity, which not only ensures good electrical contact between the inner and outer elastic pieces, but also supports the welded elastic pieces. The lower base 9 is made of insulated alumina ceramic, which can prevent electromagnetic interference of an instantaneous current to a RF cavity in addition to its fixing function.

The surfaces of the elastic pieces adopt silver graphite ball head self-lubrication, which has the advantages of good resistance to fusion welding, good electrical conductivity, low and stable contact resistance, small temperature rise, etc. The contacts of the elastic pieces are always in a stressed state of connecting the inner and outer sleeve walls, so there is a high requirement on the service life of the contacts, and it is necessary to heat treat the elastic pieces and improve the performance of materials.

When the contact slides up and down, due to the existence of contact resistance, the contact resistance will generate joule heat, which will aggravate the generation and thickening of an oxide film and cause more serious heat generation, which may lead to fusion welding or conductive damage of the contact surface. In order to solve this problem, the lower base 9 is provided with an annular water channel 12. A water inlet channel and a water outlet channel communicated with each other are provided at two opposite sides of the annular water channel, respectively, to form a circulating water channel. The water inlet channel 10 and the water outlet channel 11 are both provided penetrating through the upper base 7.

The contacts adopt a double-sided double-elastic piece structure, and the contact spring 13 generates a contact pressure to press the inner and outer elastic pieces to contact the inner and outer sleeve walls to form a short circuit, which not only meet the requirements of good electrical contact, but also can cooperate with the pull rods to axially slide so as to tune the RF cavity. Thus, slight adjustment can be made in real time no matter when the cyclotron is a stop condition or an operation condition.

Operating requirements and parameters of the tuning ring are as follows: The tuning ring has an operating frequency of 90 MHz and a fed RF power of 120 kW. A moving speed of an electrical contact member (tuning ring) is controlled between 0.01 mm/s and 0.1 mm/s. The inner sleeve has a surface magnetic field strength of 100 A/m. A RF frequency modulation cavity has a surface magnetic field strength of about 10 A/m. The temperature of the inner sleeve, the electrical contact member and the RF frequency modulation cavity may be controlled below 80 degrees Celsius, which could be 60 degrees Celsius.

The electrical contact of the disclosure is compact in structure and small in size, with a pole width of mere 18 mm and an axial length of mere 46 mm. The disclosure has a simple structure, is economical and applicable, and provides reference for the field of high frequency tuning.

INDUSTRIAL APPLICABILITY

The disclosure is proposed in order to meet the special electrical contact performance and the narrow working gap of the tuning ring. A novel double-sided elastic piece contact structure is adopted, which is more suitable for realizing high-frequency tuning in a small gap range, so that the availability and maintainability of the tuning ring are better. The overall design structure is compact, economical and applicable, and the use requirements of the tuning ring of the cyclotron are met.

What is claimed is:

1. A high-frequency-tuning sliding electrical contact, comprising a tuning ring, sliding between an outer sleeve and an inner sleeve; wherein the outer sleeve is sleeved on the inner sleeve; the tuning ring comprises an inner elastic piece, an upper base, an outer elastic piece and a lower base; the upper base and the lower base are welded as an integrity; the inner elastic piece and the outer elastic piece are uniformly provided along an axial direction and welded on the lower base; pull rods are welded to an upper side face of the upper base; and upper ends of the pull rods are driven by a motor to move up and down, such that the turning ring slides up and down between the outer sleeve and the inner sleeve along the pull rods to realize frequency tuning, and suitable for realizing high-frequency tuning in a small gap range, so that the availability and maintainability of the tuning ring are better.

2. The high-frequency-tuning sliding electrical contact according to claim 1, wherein an upper group and a lower group of pull rods with a total of eight independent pull rods are provided; the upper group and the lower group of pull rods are staggered 90 degrees and are evenly provided along the axial direction; and the upper and lower groups of pull rods are connected through a guide disk.

3. The high-frequency-tuning sliding electrical contact according to claim 1, wherein the inner elastic piece and the outer elastic piece have a width of 5 mm; and a contact spring is provided between the inner elastic piece and the lower base and between the outer elastic piece and the lower base, respectively.

4. The high-frequency-tuning sliding electrical contact according to claim 3, wherein the inner elastic piece and the outer elastic piece are both made of a Be—Cu contact material; surfaces of the inner elastic piece and the outer elastic piece are coated with silver; a thickness of the inner elastic piece and the outer elastic piece is at least 50 um.

5. The high-frequency-tuning sliding electrical contact according to claim 4, wherein front ends of the inner elastic piece and the outer elastic piece are bent and then clamped in grooves on an upper part of the lower base; and the surfaces of the inner and outer elastic pieces adopt silver graphite ball head self-lubrication.

6. The high-frequency-tuning sliding electrical contact according to claim 1, wherein the upper base is made of a copper material; and the lower base is made of insulated alumina ceramic.

7. The high-frequency-tuning sliding electrical contact according to claim 6, wherein an annular water channel is provided in the lower base along an annular direction thereof; and a mutually communicated water inlet channel and water outlet channel are provided at two opposite sides of the annular water channel, respectively, to form a circulating water channel; and the water inlet channel and the water outlet channel are both provided penetrating through the upper base.

8. The high-frequency-tuning sliding electrical contact according to claim 1, wherein the tuning ring has an operating frequency of 90 MHz and a fed RF power of 120 kW; a moving speed of an electrical contact member is controlled between 0.01 mm/s and 0.1 mm/s; the inner sleeve has a surface magnetic field strength of 100 A/m; a RF frequency modulation cavity has a surface magnetic field strength of about 10 A/m; and a temperature of the inner sleeve, the electrical contact member and the RF frequency modulation cavity is controlled below 80 degrees Celsius.

* * * * *